US010870195B2

(12) United States Patent
Sergyeyenko et al.

(10) Patent No.: US 10,870,195 B2
(45) Date of Patent: Dec. 22, 2020

(54) POWER TOOL WITH STORAGE SYSTEM

(71) Applicant: BLACK & DECKER INC., New Britain, CT (US)

(72) Inventors: Oleksiy Sergyeyenko, Baldwin, MD (US); Sean Bailey, Towson, MD (US); Justin Barkley, Columbia, MD (US); David A. Miller, Aberdeen, MD (US); Tyler Knight, Ellicott City, MD (US); Jason McRoberts, Red Lion, PA (US); Ashok Samuel Baskar, Lutherville, MD (US)

(73) Assignee: Black & Decker Inc., New Britain, CT (US)

( * ) Notice: Subject to any disclaimer, the term of this patent is extended or adjusted under 35 U.S.C. 154(b) by 647 days.

(21) Appl. No.: 15/440,305

(22) Filed: Feb. 23, 2017

(65) Prior Publication Data

US 2018/0154509 A1 Jun. 7, 2018

Related U.S. Application Data

(60) Provisional application No. 62/430,672, filed on Dec. 6, 2016, provisional application No. 62/448,605, filed on Jan. 20, 2017.

(51) Int. Cl.
*B25F 5/02* (2006.01)
*B25B 21/00* (2006.01)

(52) U.S. Cl.
CPC ..... *B25F 5/029* (2013.01); *B25B 21/00* (2013.01)

(58) Field of Classification Search
CPC ..... B25C 1/08; B25F 5/027; B25F 5/029
USPC ..... 173/217
See application file for complete search history.

(56) References Cited

U.S. PATENT DOCUMENTS 4,810,137 A * 3/1989 Yang ..... B25H 1/0042 408/100
4,932,294 A * 6/1990 Chang ..... B25F 5/02 206/234
5,056,661 A 10/1991 Balzano
5,121,803 A 6/1992 Hartmann et al.
5,445,479 A * 8/1995 Hillinger ..... B25F 5/00 16/430
6,334,743 B1 1/2002 Liao
(Continued)

FOREIGN PATENT DOCUMENTS

DE 9209104 9/1992
DE 20105767 U1 7/2001
(Continued)

*Primary Examiner* — Robert F Long
*Assistant Examiner* — Xavier A Madison
(74) *Attorney, Agent, or Firm* — Stephen R. Valancius

(57) ABSTRACT

A power tool including a housing comprising a handle section and a motor housing section, a longitudinal axis of the handle section being at an offset angle with respect to a longitudinal axis of the motor housing section. A motor is housed in the motor housing section. An output member selectively driven by the motor. A user actuatable trigger activates the motor and an attachment unit is removably coupled to the power tool. The handle runs from a first end to a second end. The first end is adjacent to the motor housing section and the second end is adjacent to a connection section. The attachment unit is removably coupled to the power tool at the connection section.

16 Claims, 11 Drawing Sheets

(56) References Cited

U.S. PATENT DOCUMENTS

| | | | | |
|---|---|---|---|---|
| 6,364,580 | B1 | 4/2002 | Dils et al. | |
| 6,902,356 | B2 | 6/2005 | Breitenmoser | |
| 6,979,155 | B2 | 12/2005 | Dils et al. | |
| 7,108,079 | B2 | 9/2006 | Sakai et al. | |
| 7,150,587 | B2 | 12/2006 | Dils et al. | |
| 7,217,069 | B2 * | 5/2007 | Dils | B25F 5/00 310/47 |
| 7,547,167 | B2 * | 6/2009 | Baber | B25F 5/029 409/182 |
| 7,591,616 | B1 * | 9/2009 | Kerner | B25F 5/029 206/379 |
| 7,665,541 | B2 | 2/2010 | Sakai et al. | |
| 7,681,661 | B2 | 3/2010 | Sakai et al. | |
| 9,415,499 | B2 | 8/2016 | Brotto et al. | |
| 2002/0110431 | A1 * | 8/2002 | Dils | B25F 5/029 408/16 |
| 2006/0104732 | A1 | 5/2006 | Huang | |
| 2007/0227310 | A1 * | 10/2007 | Roehm | B25F 5/021 81/54 |
| 2008/0311795 | A1 | 12/2008 | Brotto et al. | |

FOREIGN PATENT DOCUMENTS

| | | | |
|---|---|---|---|
| EP | 1595654 | A1 | 11/2005 |
| GB | 2397513 | A1 | 7/2004 |
| JP | 56056388 | A2 | 5/1981 |

* cited by examiner

POWER TOOL WITH STORAGE SYSTEM

CROSS-REFERENCE TO RELATED APPLICATIONS

This application claims the benefit of U.S. Provisional Application No. 62/430,672 filed on Dec. 6, 2016, entitled Power Tool With Storage System and U.S.

Provisional Application No. 62/448,605 filed on Jan. 20, 2017, entitled Power Tool With Storage System. The entire contents of U.S. Provisional Application No. 62/430,672 and U.S. Provisional Application No. 62/448,605 are incorporated herein by reference.

FIELD OF THE INVENTION

The present invention relates to power tools, particularly to a power tool with a storage feature for storing accessories or other tools which may be used in addition to or in conjunction with the power tool.

BACKGROUND

There are various existing powered screwdrivers with storage features. It is desired to provide a screwdriver with a storage or other attachment unit which is couplable with the screwdriver in a quick and efficient manner.

SUMMARY

According to an aspect of an exemplary embodiment, there is a power tool. The power tool includes a housing comprising a handle and a motor housing section, a longitudinal axis of the handle being at an offset angle with respect to a longitudinal axis of the motor housing section. A motor is housed in the motor housing section. An output member is selectively driven by the motor. A user actuatable trigger activates the motor and an attachment unit is removably coupled to the power tool. The handle runs from a' first end to a second end, the first end being adjacent to the motor housing section and the second end being adjacent to a connection section. The attachment unit is removably coupled to the power tool at the connection section.

The attachment unit may be a storage container.

The storage container may include an upper housing and a lower housing which define a storage space therebetween.

The upper housing may be movable relative to the lower housing at least when the storage unit is not coupled to the power tool.

At least one of bits and screws may be held in the storage container.

The connection section may include at least one of a slot and rail and the attachment unit includes the other of a slot and a rail and wherein the slot and the rail engage to couple the attachment unit to the power tool.

The attachment unit may slide onto the connection section to couple the attachment unit to the power tool.

The attachment unit may slide onto the connection section in a direction generally parallel to the longitudinal axis of the motor housing section.

The attachment unit may include an upper housing and a lower housing.

There may be at least one first rail on the upper housing and at least one second rail on the lower housing.

The connection section may include at least one first slot configured to receive the at least one first rail.

The connection section may include at least one second slot configured to receive the at least one second rail.

The power tool may be a screwdriver.

According to another aspect, there is an exemplary embodiment of a power tool. The power tool includes a housing comprising a handle section, a motor housing section and a connection section. A motor is housed in the motor housing section. An output member is selectively driven by the motor. A user actuatable trigger activates the motor. An attachment unit is removably coupled to the connection section. The attachment unit includes an upper housing and a lower housing. There is at least one first rail on the upper housing and at least one second rail on the lower housing. The connection section includes at least one first slot configured to receive the at least one first rail. The connection section includes at least one second slot configured to receive the at least one second rail.

The upper housing may be movable relative to the lower housing at least when the attachment unit is not coupled to the connection section.

The upper housing may be rotatable relative to the lower housing at least when the attachment unit is not coupled to the connection section.

The upper housing may be connected to the lower housing via a hinge.

The attachment unit may slide onto the connection section to couple the attachment unit to the power tool.

The attachment unit may slide onto the connection section in a direction generally parallel to the longitudinal axis of the motor housing section.

The attachment unit may be a storage container which includes an upper housing and a lower housing which define a storage space therebetween.

When the attachment unit is coupled to the connection section, the upper housing may not movable relative to the lower housing.

When the attachment unit is not coupled to the connection section, the upper housing may be movable relative to the lower housing.

According to another aspect, there is an exemplary embodiment of a power tool including a housing comprising a handle, a motor housing section and a connection section. A motor is housed in the motor housing section. An output member is selectively driven by the motor. A user actuatable trigger activates the motor. An attachment unit is removably coupled to the connection section. The attachment unit includes an upper housing and a lower housing. When the attachment unit is coupled to the connection section, the upper housing is not movable relative to the lower housing. When the attachment unit is not coupled to the connection section, the upper housing is movable relative to the lower housing.

The attachment unit may be a storage container.

A storage space may be defined between the upper housing and lower housing.

The power tool may be a screwdriver.

DETAILED DESCRIPTION OF EXEMPLARY EMBODIMENTS

Power tools often require an accessory or other tool in order to perform a function. For example, a screwdriver holds and drives a screwdriver bit which drives a screw into a workpiece. The screwdriver bit and the screw are used in conjunction with the screwdriver to perform the work. Similarly, a drill holds a drill bit in order to drill a hole in a workpiece. Of course, screwdrivers and drills may hold a variety of different types of bits. For example, a screwdriver or drill may hold a flat head screwdriver bit, a Phillips head screwdriver bit, a hex bit, etc. Additionally, there may be different sizes. Accordingly, because different accessories may be useful for different tasks, it may be helpful to a user to hold a variety of accessories on the power tool itself.

Figure 4:
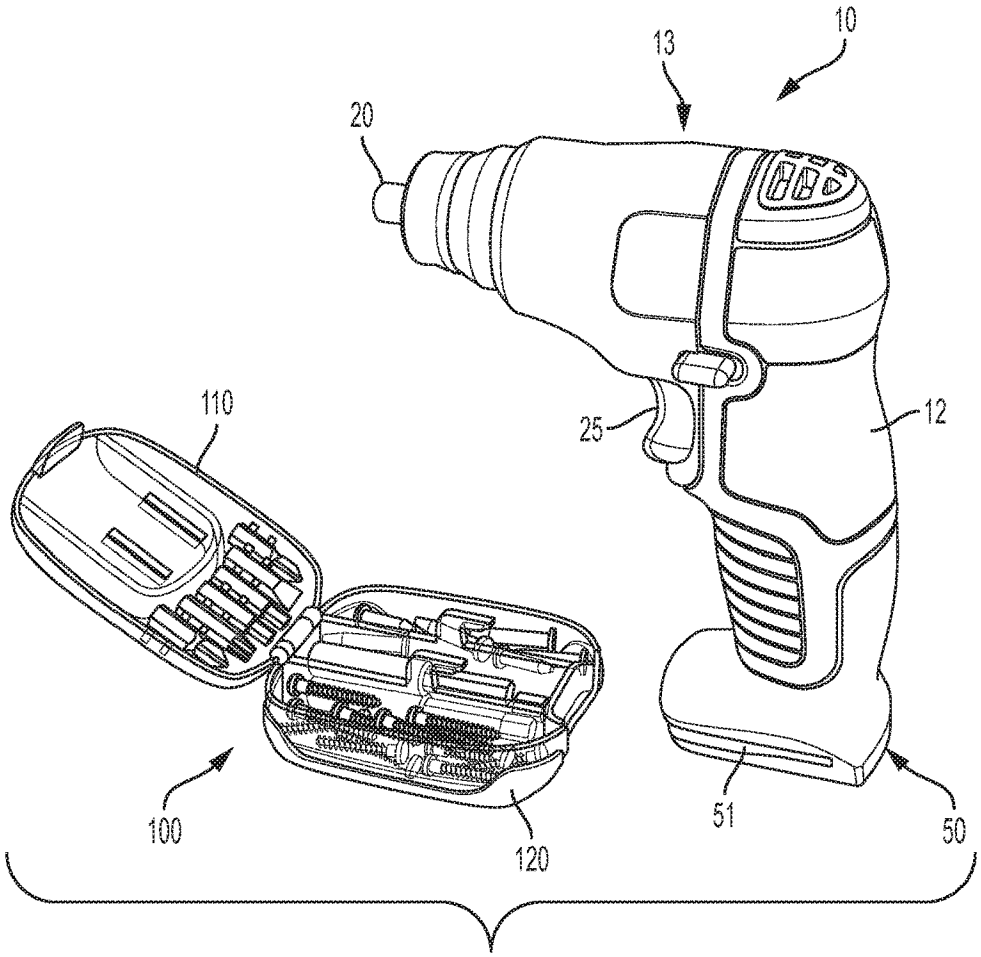
FIG. 4 is another perspective view of the screwdriver and storage container with the storage container decoupled from the screwdriver.
Figure 5:
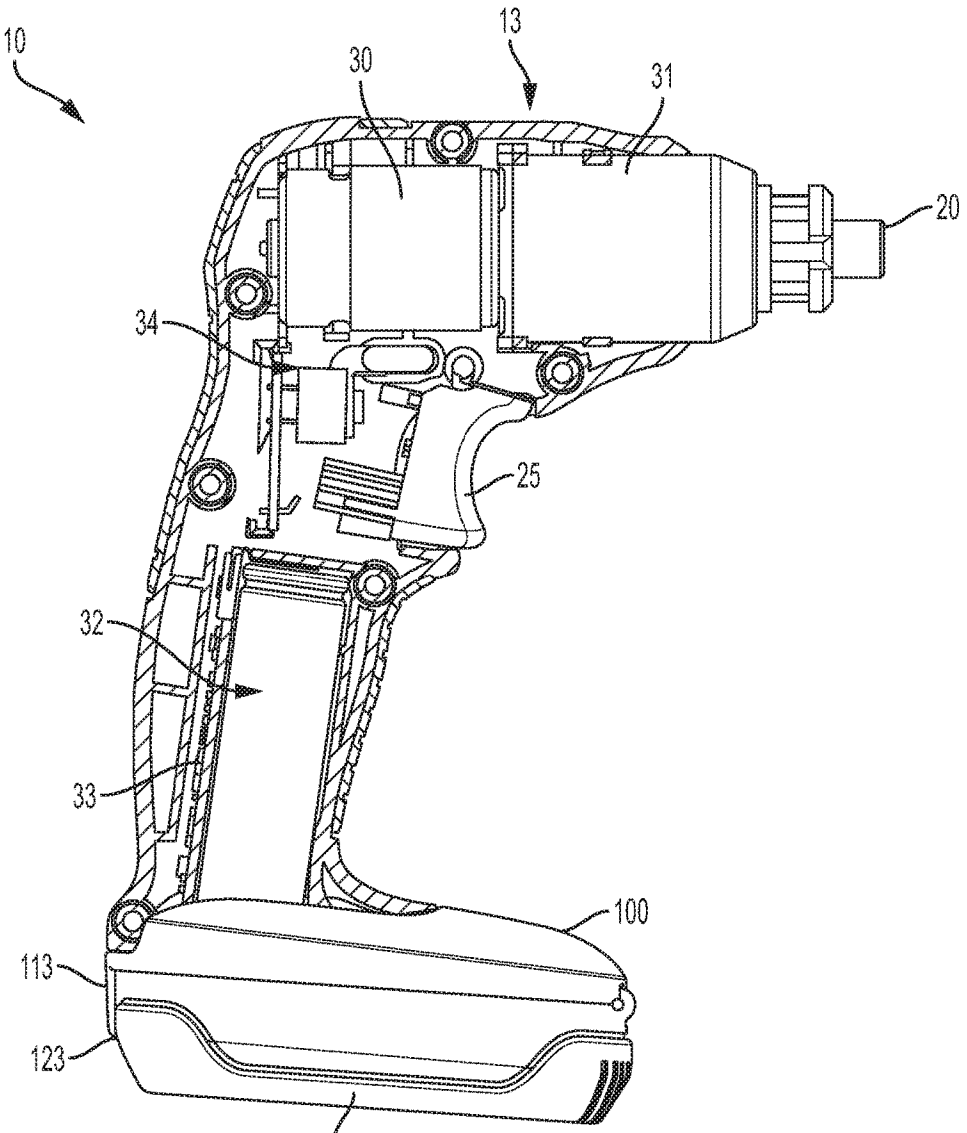
FIG. 5 is a side view of the screwdriver with a housing half removed.

An exemplary embodiment of the present application is shown in FIGS. 1-13. As shown the power tool of the exemplary embodiment is a screwdriver 10. The basic function of the screwdriver 10 is generally conventional. The screwdriver 10 has a housing with a handle 12 which can be gripped by a user to hold the screwdriver and a motor housing section 13 which houses a motor 30 (FIG. 5). The handle 12 has a longitudinal axis A and the motor housing 13 has a longitudinal axis B that is angled with respect to the longitudinal axis A. The handle 12 has an upper end adjacent to the motor housing 13 and a lower end adjacent to a connection section 50 at which a storage container 100 can be attached to the screwdriver 10.

FIG. 5 is a view of the screwdriver 10 with one of the housing half shells removed so that the internals can be seen. As shown in FIG. 5, the screwdriver housing houses a battery 32 next to a printed circuit board 33. The battery 32 and the printed circuit board 33 are housed in the handle 12. As shown, the motor housing section 13 houses a motor 30 and a gear box 31 extends out of the motor housing section 13. The motor 30 is powered by the battery 33. When a user actuates the trigger 25, the motor 30 is activated. The motor 30 rotationally drives an output member 20 through a transmission gearbox 31. There is a forward/reverse switch 34 for changing the direction in which the output member 20 is driven between forward and reverse. In this case, the output member 20 is a hexagonal bit holder. In other embodiments, there may be other types of bit holders. For example, the power tool could be a drill with a chuck.

Figure 2:
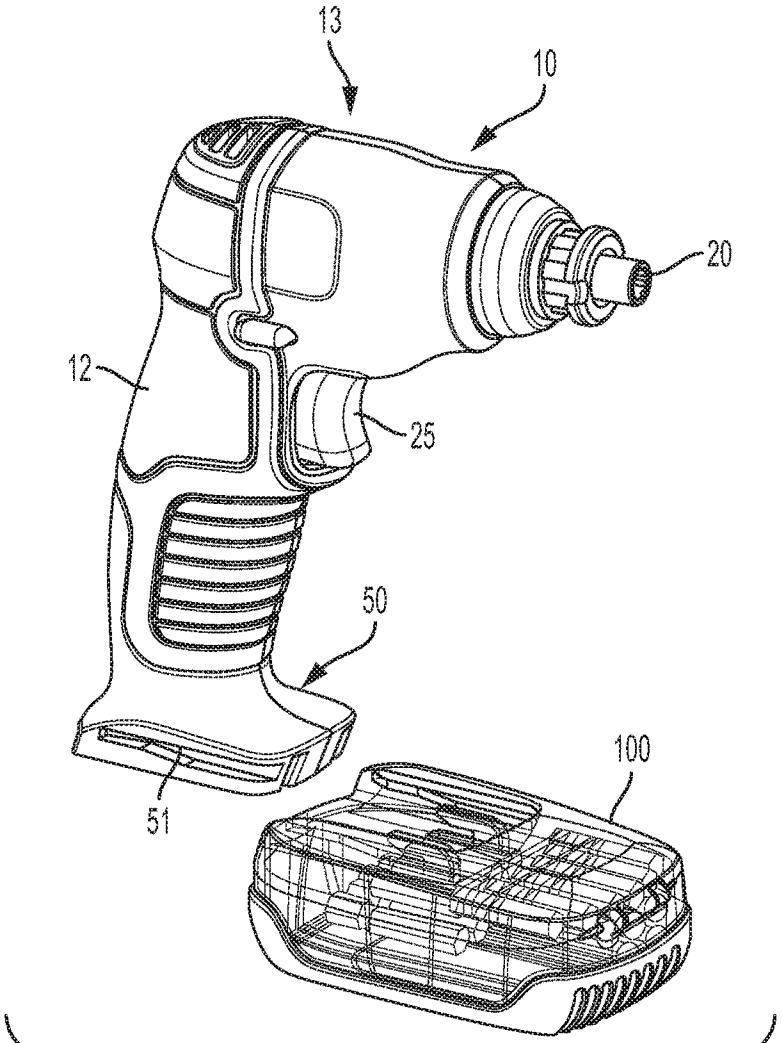
FIG. 2 is a perspective view of the screwdriver and storage container with the storage container decoupled from the screwdriver.
Figure 1:
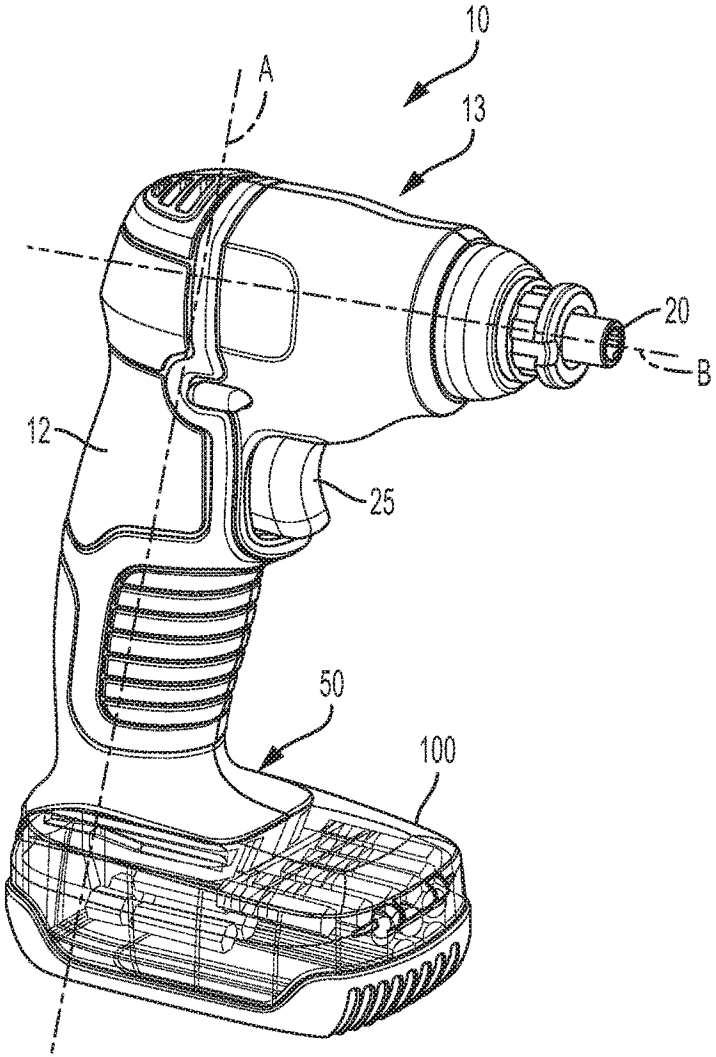
FIG. 1 is a perspective view of a screwdriver and storage container according to an exemplary embodiment.
Figure 3:
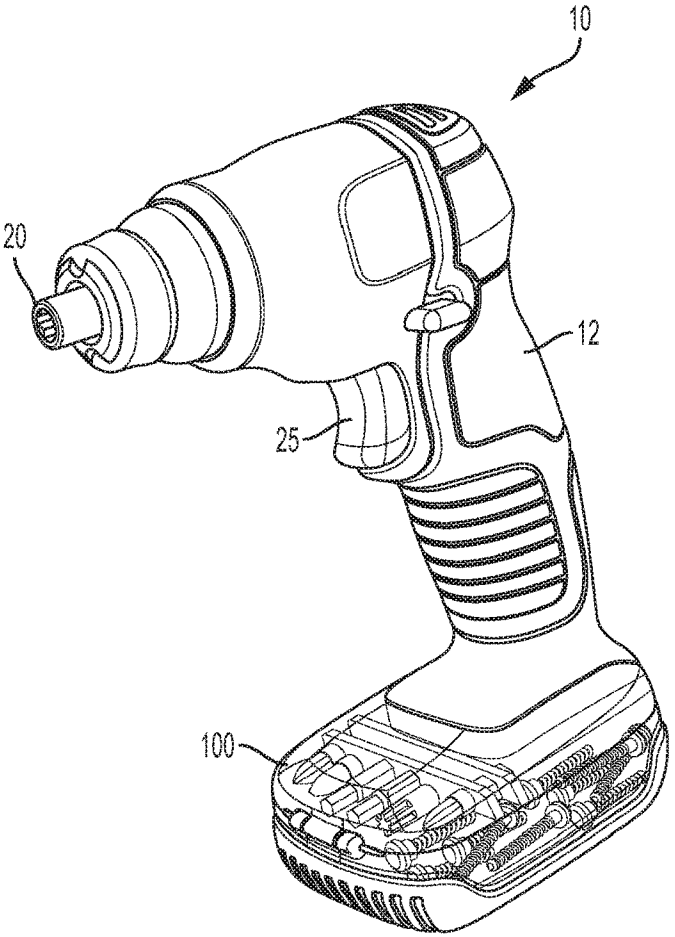
FIG. 3 is another perspective view of a screwdriver and storage container according to an exemplary embodiment.
Figure 6:
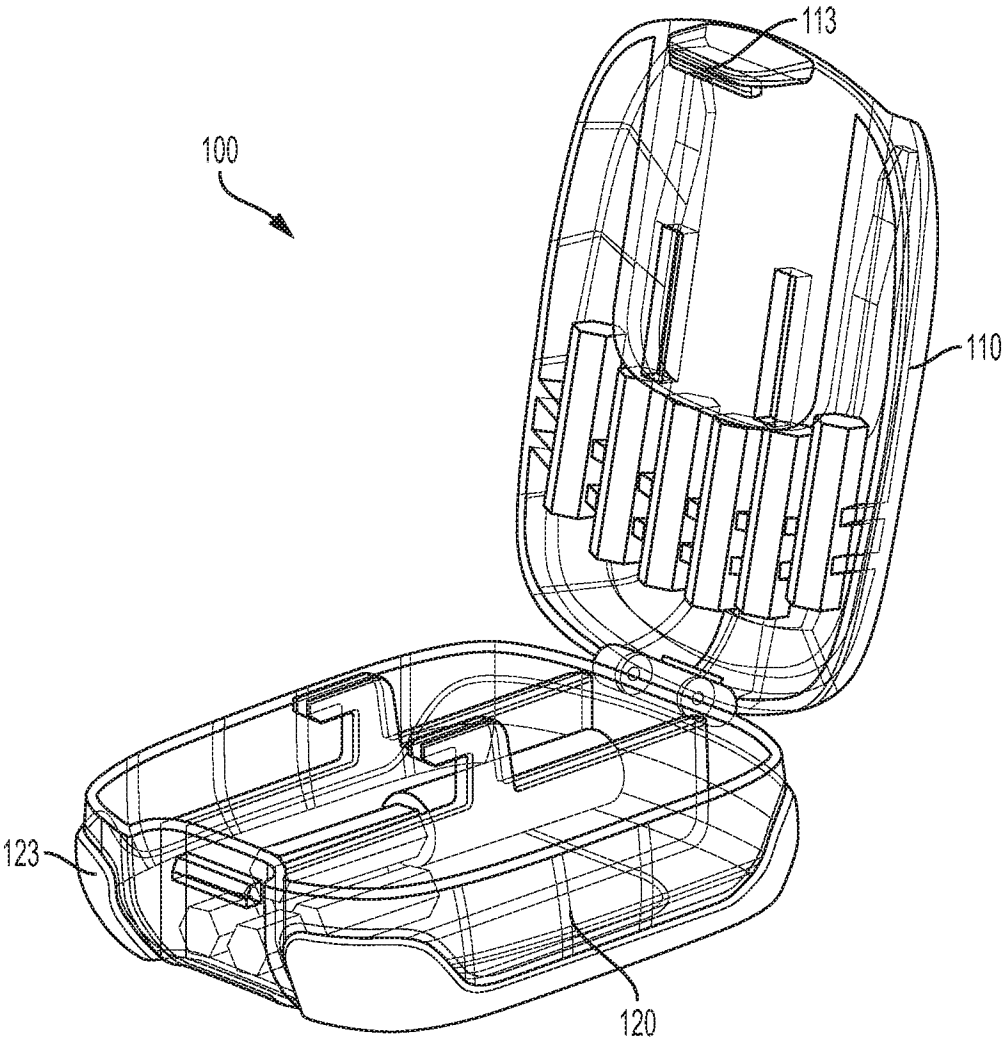
FIG. 6 is a perspective view of the storage container.
Figure 7:
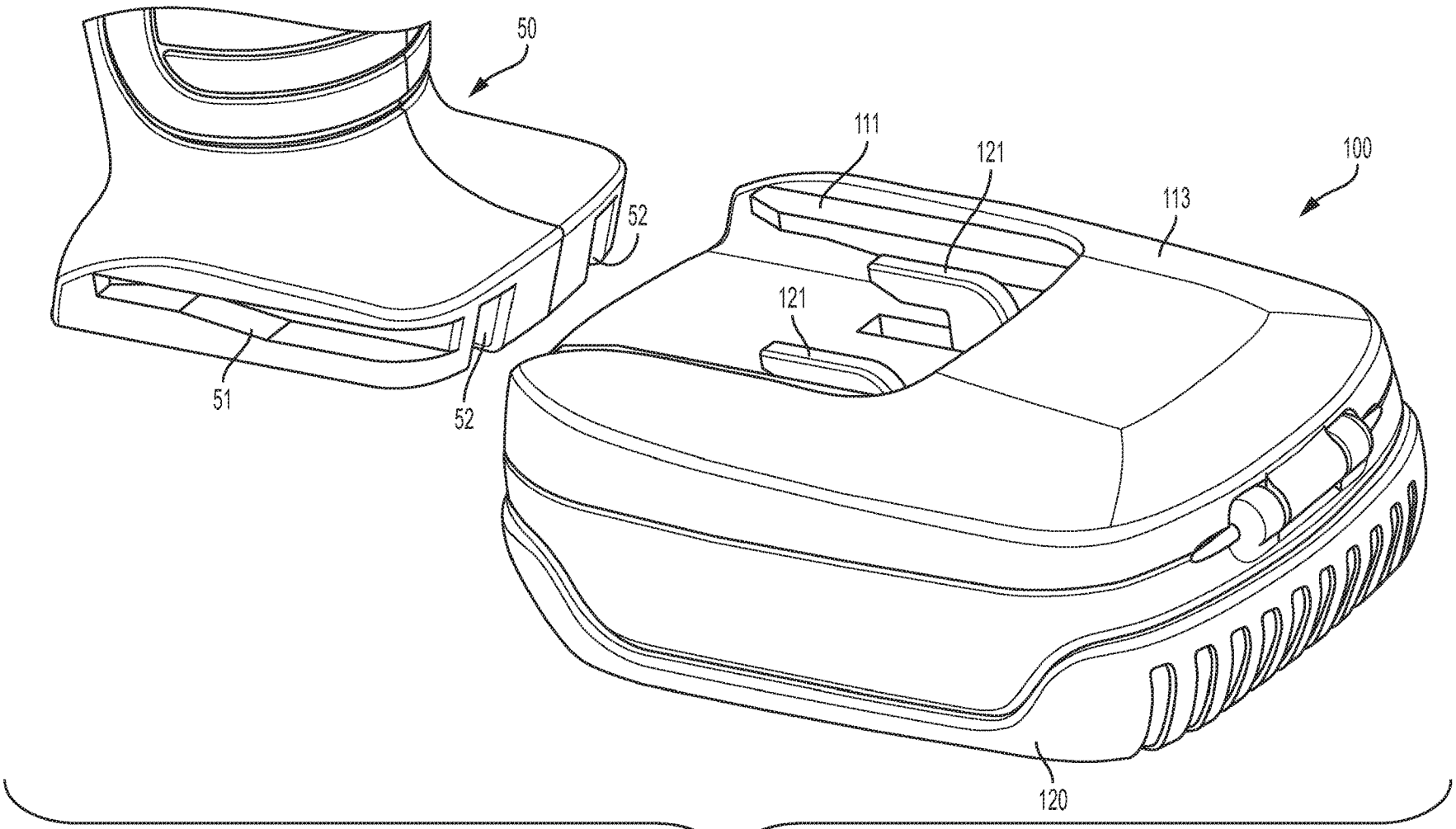
FIG. 7 is a perspective view of the storage container and a connection section of the screwdriver.

Referring back to FIGS. 1-4, the screwdriver 10 of the exemplary embodiment includes a removably coupled storage container 100. The screwdriver 10 has a connection portion 50 at its lower end. The storage container 100 can be coupled to the screwdriver 10, as shown in FIGS. 1 and 3, or removed from the screwdriver 10 as shown in FIGS. 2 and 4. As shown in FIGS. 4 and 6, and discussed in more detail below, the storage container 100 defines an internal space in which various objects can be stored. The storage container 100 can store screwdriver bits, screws picture hangers and the like. Thus, a user can remove the storage container 100 from the screwdriver 10, open the storage container 100 and then select a bit and screw for use. The storage container 100 is slid onto the screwdriver 10 at a connection section 50 in a direction generally parallel to the longitudinal axis B of the motor housing 13.

The storage container 100 includes a bottom housing 120 and a top housing 110. The storage container 100 also includes a hinge 130 so that the top housing 110 can pivot with respect to the bottom housing 120. As shown in, for example, FIGS. 5 and 6, the storage container 100 also includes an upper housing latch member 113 and a lower housing latch member 123. These latch members 113, 123 cooperate to keep the storage container 100 closed unless a user provides sufficient force to open the container 100. That is, the latch member 113, 123 provide a latching force that can be overcome so that a user can open the container 100. In FIGS. 1-4 and 6, portions of the storage container 100 are shown clear so that the internal storage can be seen. In the invention, the storage container 100 may be made entirely opaque, entirely clear or have some parts opaque and others clear.

Connection of the storage container 100 to the screwdriver 10 will be explained in further detail with reference to FIGS. 7-12. As shown in FIGS. 7-12, the connection portion 50 includes a pair of first receiving slots 51 and a pair of second receiving slots 52. The storage container 100 includes a pair of first rails 111 and a pair of second rails 121. The pair of first rails 111 are integrally formed with the top housing 110 and the pair of second rails 121 are integrally formed with the bottom housing 120. Accordingly, when the top housing 110 is rotated with respect to the bottom housing 120, the first rails 111 rotate along with the top housing 110 while the second rails 121 stay with the bottom housing 120. In order to couple the storage container 100 to the connection section 50, the first rails 111 engage the first slots 51 and the second rails 121 engage the second slots 52. As will be appreciated, because both the top housing 110 and the bottom housing 120 are engaged with the connection section 50, the storage container 100 of the shown exemplary embodiment cannot be opened when the storage container 100 is attached to the screwdriver 10.

Figure 8:
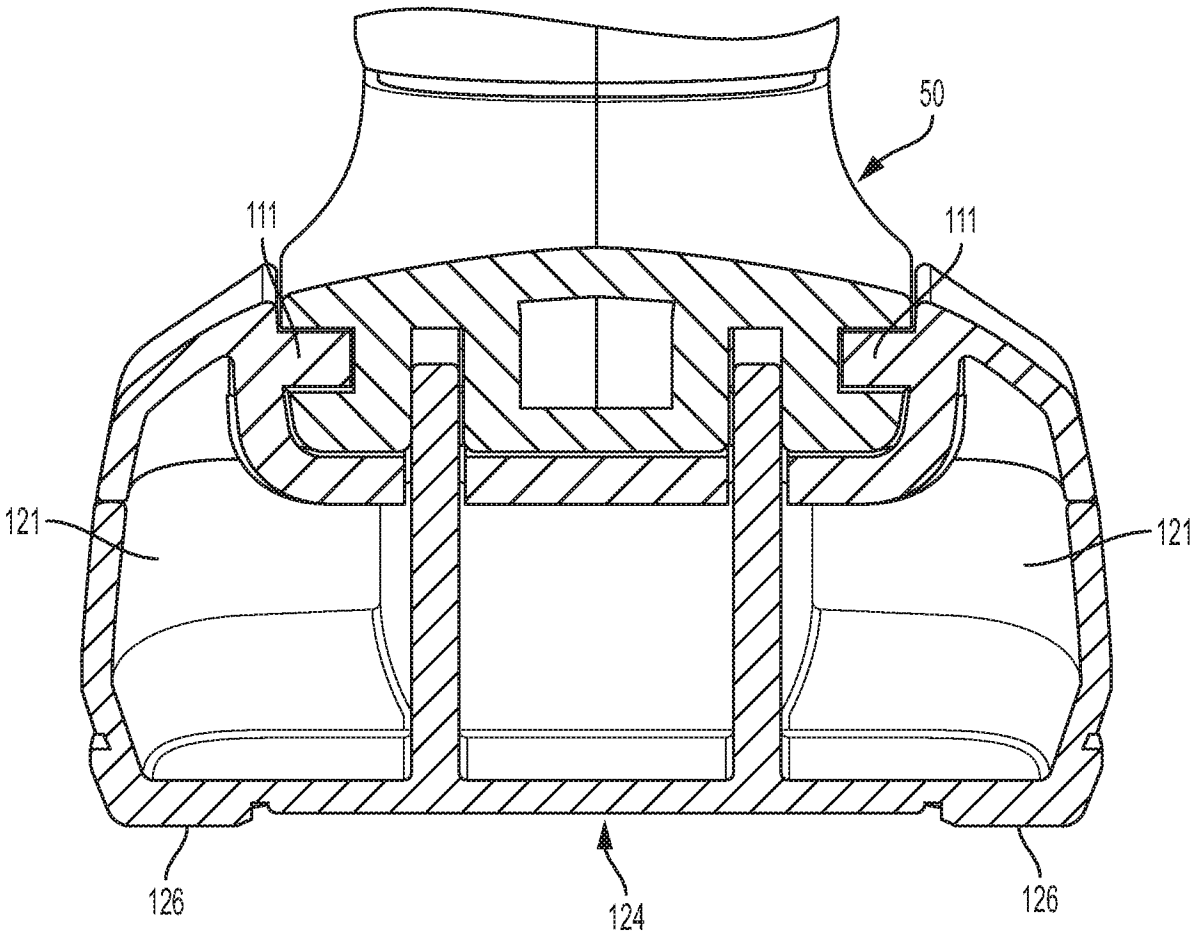
FIG. 8 is a cross-sectional view of the connection of the storage container and the connection section.

FIGS. 8-12 are various cross-sectional views which further explain how the container 100 is engaged with the connection section 50 to couple it thereto. FIG. 8 is a rear cross-sectional view. As shown in FIG. 8, the two second rails 121 extend from the lower housing 120 through the upper housing 110 and into the second receiving slots 52. FIG. 8 shows how the second rails 121 extend into the second receiving slots 52. Other figures will illustrate how the rails 121 and slots 52 cooperate to prevent downward movement of the rails 121 and, therefore, the lower housing 120.

As is also shown in FIG. 8, the first rails 111 extend into the first receiving slots 51. As is shown in FIG. 8, the cooperation of the first rails 111 and the receiving slots 51 couple the upper housing 110, and the storage container 100 generally, to the screwdriver 10.

Figure 10:
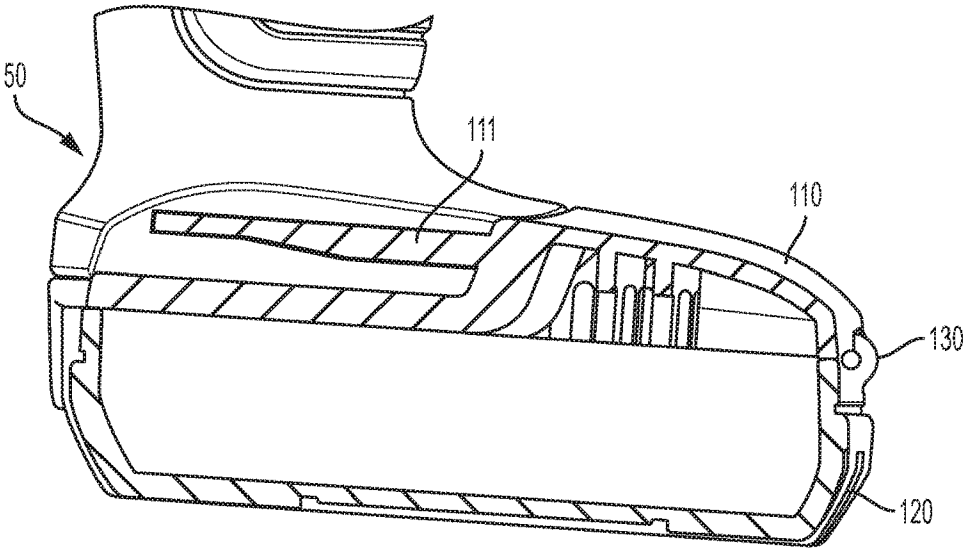
FIG. 10 is a cross-sectional view of the connection section and storage container with the storage container coupled to the connection section.
Figure 9:
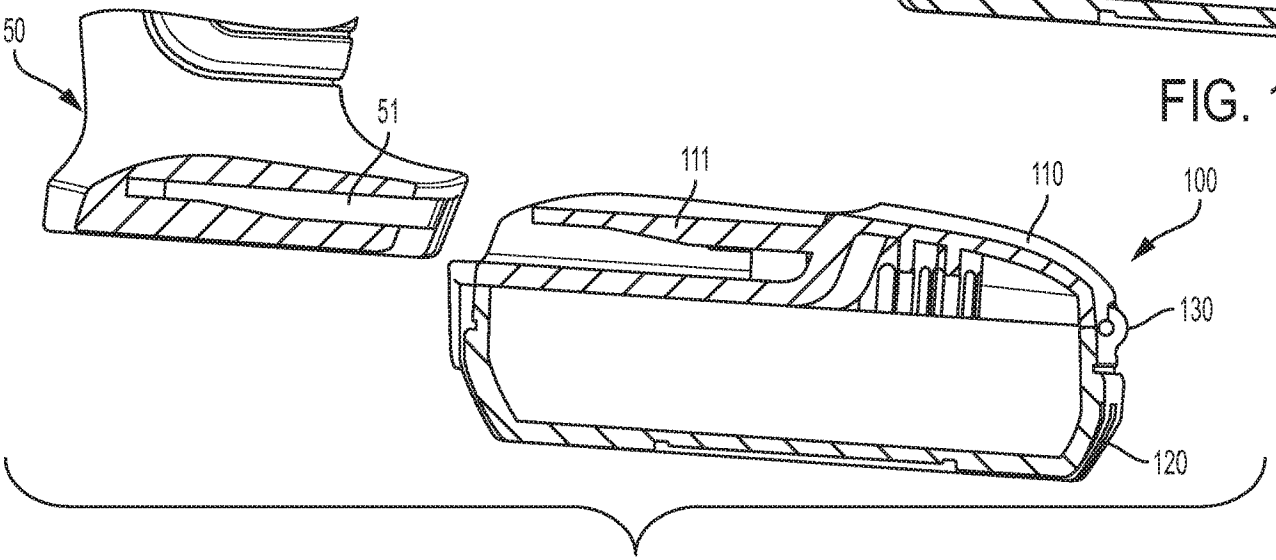
FIG. 9 is a cross-sectional view of the connection section and storage container with the storage container decoupled from the connection section.

FIGS. 9 and 10 illustrate a side cross-sectional view with a depth that cuts through the first rails 111. As shown in FIGS. 9 and 10, the shape and size of the first receiving slots 51 match the shape and size of the first rails 111. Accordingly, a user can slide the storage container 100 from a position where it is not coupled (FIG. 9) so that it is coupled with the connection section 50 as shown in FIG. 10 and the first slots 51 will receive the first rails 111.

Figure 12:
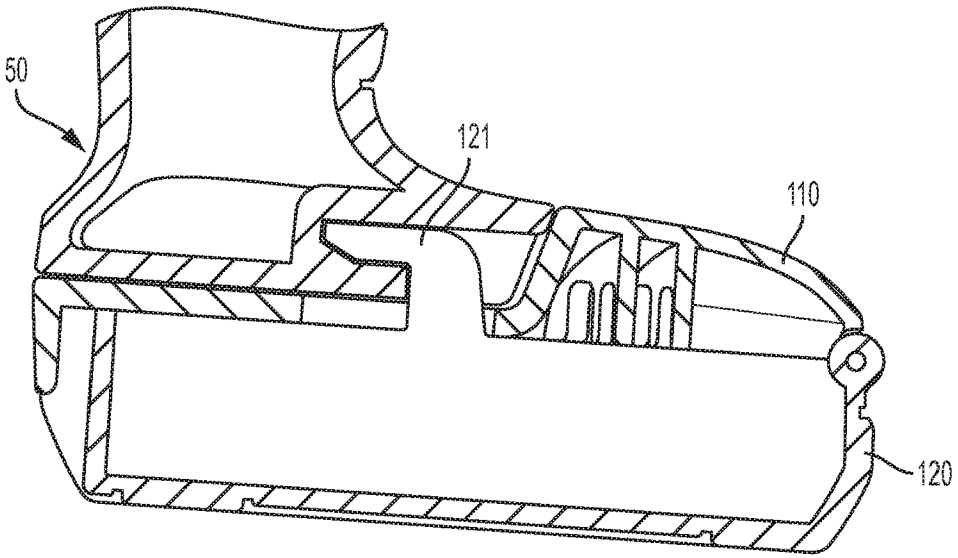
FIG. 12 is another cross-sectional view of the connection section and storage container with the storage container coupled to the connection section.
Figure 11:
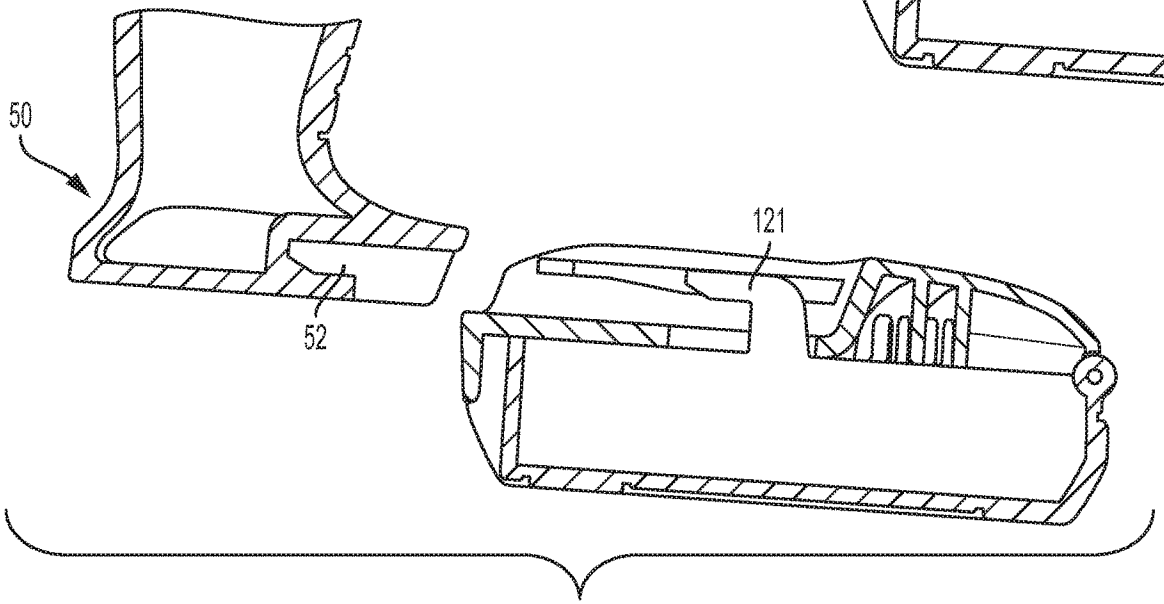
FIG. 11 is another cross-sectional view of the connection section and storage container with the storage container decoupled from the connection section.

FIGS. 11 and 12 illustrate a side cross-sectional view with a depth that cuts through the second rails 121 so that the coupling of the second rails 121 with the second receiving slots 52 can be easily seen. As shown in FIGS. 11 and 12, the second rail 121 has a hook shape. That allows the rail to extend from the lower housing 120 and cooperate with the second slot 52. As will be appreciated, when the storage container 100 is slid onto the connection section 50, the pair of second slots 52 receive the pair of second rails 121 and secure the storage container 100 to the connection section 50.

According to the exemplary embodiment, the storage container 100 includes a first pair of rails 111 which engage a pair of first receiving slots 51 and a second pair of rails 121 which engage a pair of second receiving slots 52. The engagement of the rails 111, 121 and slots 51, 52 secure the storage container to the screwdriver 10 at the connection section 50. Additionally, because there are both a first pair of rails 111 from the upper housing 110 and a second pair of rails 121 from the lower housing 120, the upper housing 110 and lower housing 120 are prevented from relative movement. That is, the storage container 100 is secured in a closed position when engaged to the connection section 50 of the screwdriver.

Although not shown, the slots 51, 52 and rails 111, 121 may have a detent system so that the storage container 100 does not inadvertently slide off of the connection section 50. The detent system simply provides detents on one or more of the rails or slots to restrict movement. The detents can be overcome by the force of a user sliding the container 100 on to or off of the connection section 50. Alternatively or additionally, the container 100 may be held onto the connection section 50 by a frictional fit.

Figure 13:
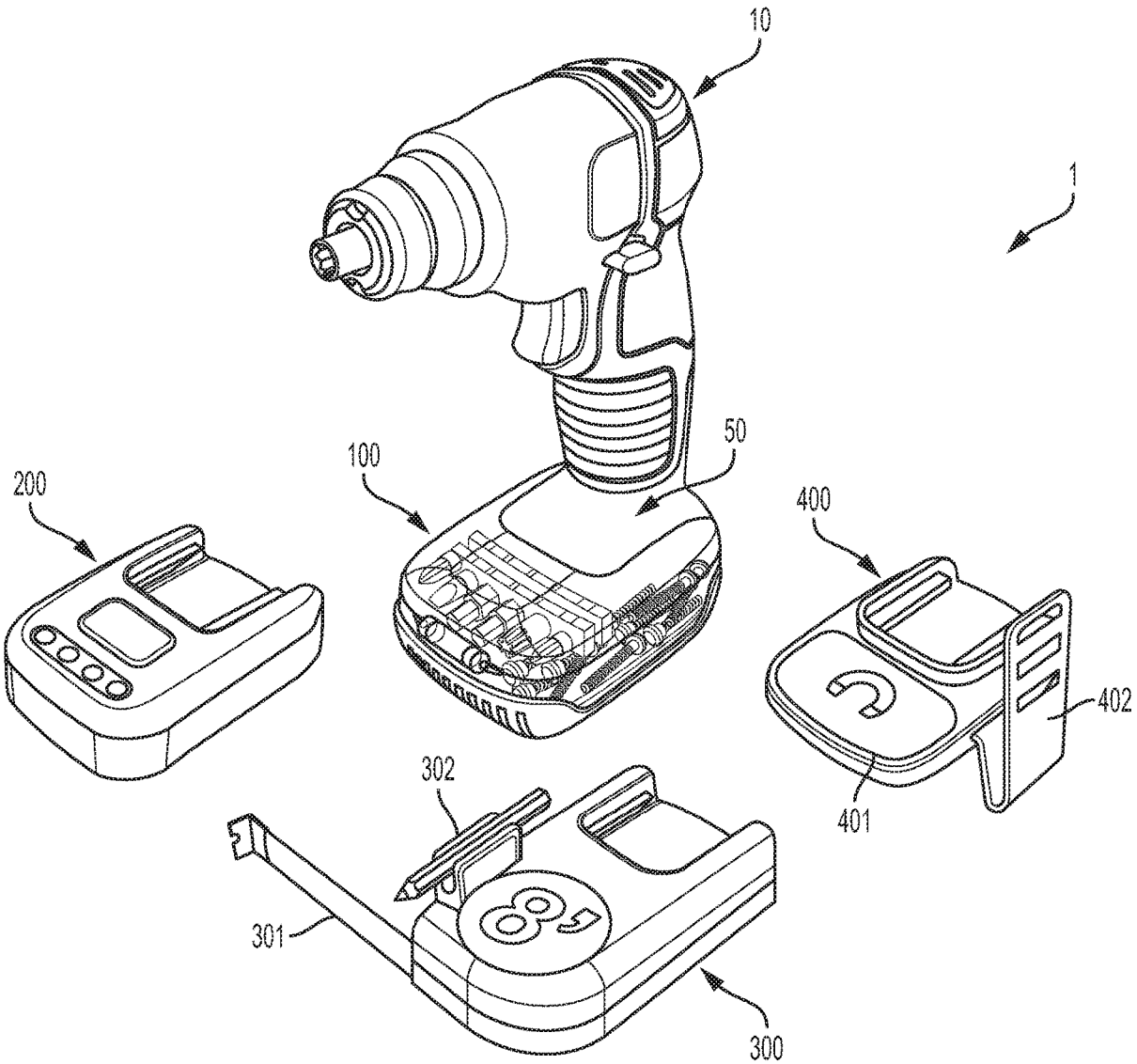
FIG. 13 is a perspective view of the screwdriver with a system of attachments.

As shown in FIG. 13, according to the exemplary embodiment there may be a system 1 which includes a screwdriver 10 and a number of different user attachments. That is, in addition to the storage container 100, there may be additional user attachments which could be selectively coupled to the connection section 50. For example, in FIG. 13, there is a stud finder attachment 200, a tape measure and pencil holder attachment 300 and a magnetic bit holder and belt clip attachment 400. Each of the attachments 200, 300, 400 includes at least some rails that couple to the receiving slots 51 and 52 of the connection section 50. For example, the attachments 200, 300, 400 may have a comparable set of rails as the storage container 100, meaning a pair of first rails which fit into the first receiving slots 51 and a pair of second rails which fit into the second receiving slots 52. However, because they are not openable containers, the attachments 200, 300, 400 may not need both pairs of rails. For example, they may include only a first set of rails 111 which engage the first receiving slots 51 and those rails sufficiently secure the attachments 200, 300, 400.

The stud finder attachment 200 (also known as a hidden object detector or stud sensor) is a stud finder which detects beams or other materials behind walls. The attachment 300 includes a tape measure 301 which can extend and retract into the housing of the attachment 300 and can be used to measure objects. A pencil holder 302 is also included. The attachment 400 includes a magnetic tray 401 which is magnetized so bits or screws are held in place for use. It also includes a belt clip 402. In the system 1 of the exemplary embodiment, a user can attach one of the various attachments 100, 200, 300, 400 and take it with him to provide for greater flexibility. For example, the user can detach the storage container 100 from the screwdriver 10 and replace it with the stud finder 200 by sliding the stud finder onto the connection section 50. If a user then wants to take a tape measure with him, the user may detach the stud finder 200 and slide the attachment 300 onto the connection section 50 of the screwdriver 10. Although four particular different attachments 100, 200, 300, 400 are shown and describe, various other attachment units may be included in the system 1.

As shown in FIGS. 5 and 8, the lower housing 120 of the storage container 100 includes a bottom surface 124 which is suitable for standing the screwdriver 10 with the attached storage container on a flat horizontal surface. When the screwdriver 10 with storage container 100 is placed on such a flat surface, the screwdriver 10 stands upright with the storage container 100 on the flat horizontal surface. This makes the screwdriver 10 easy to set down and pick up.

Figure 14:
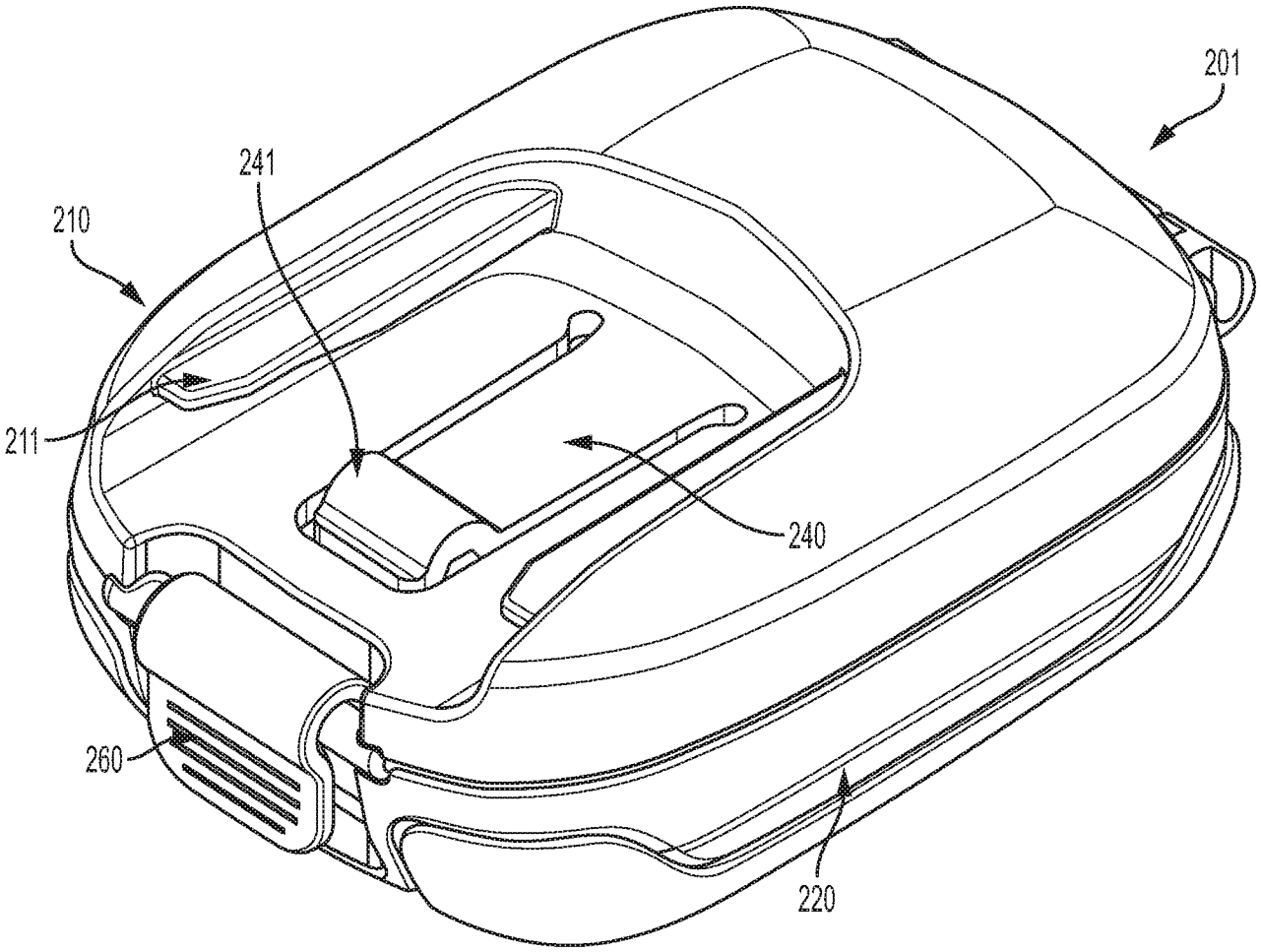
FIG. 14 is a perspective view of another embodiment of a storage container.

FIG. 14 illustrates another embodiment of a storage container. Storage container 201 is the same as storage container 100, unless shown or described otherwise. Storage container 201 includes an upper housing 210 and a lower housing 220 which form a storage space therebetween. The housings 210 and 220 are movable with respect to one another about a hinge 230. However, unlike, storage container 100, storage container 201 includes only a set of first rails 211. The first rails 211 are formed on the upper housing 211 and are configured to fit into the first receiving slots 51. The storage container 201 does not include any second rails extending from the lower housing 220. Accordingly, with the second storage container 201, the second receiving slots 52 are not used.

Figure 15:
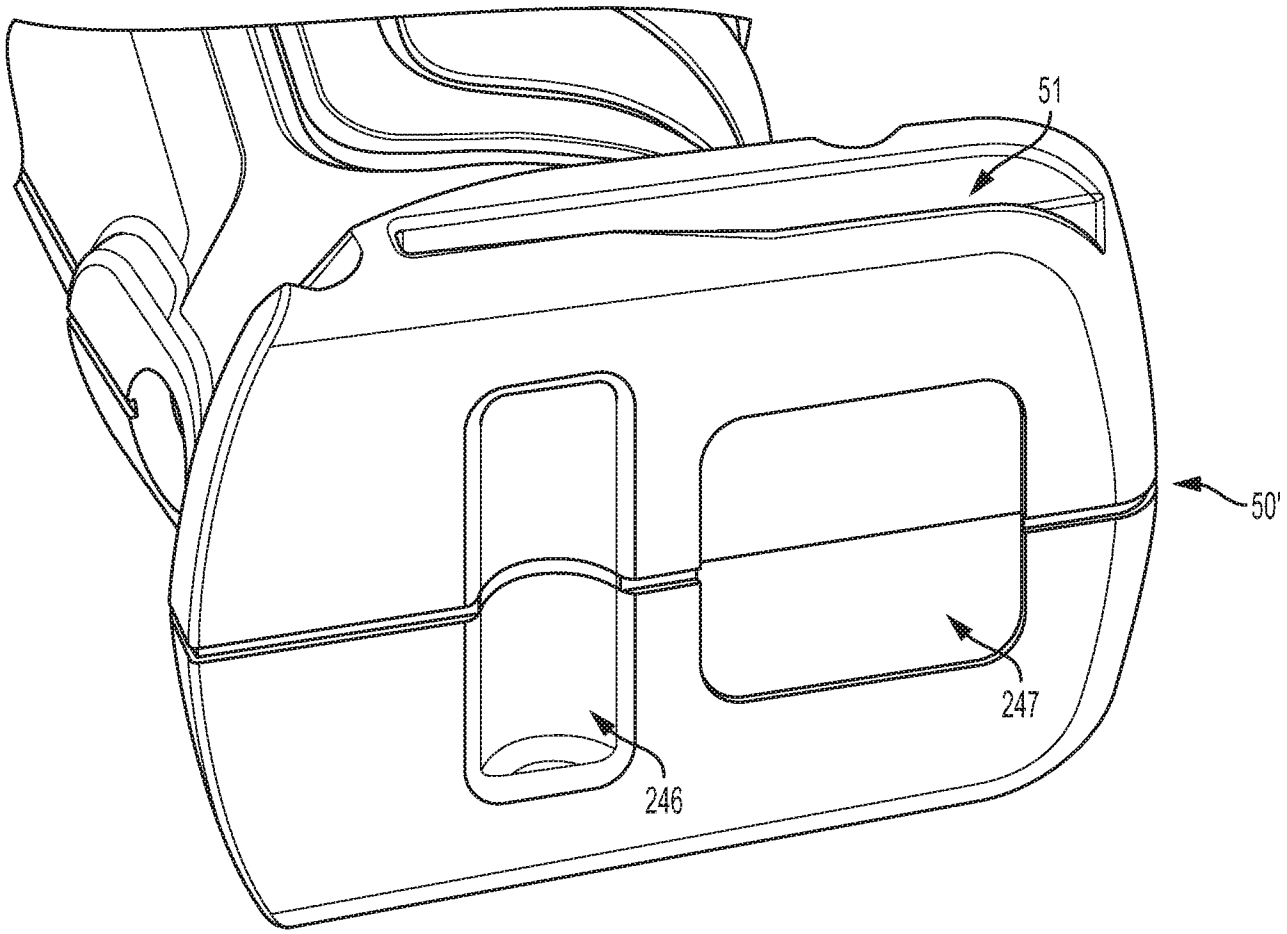
FIG. 15 is a perspective view of another embodiment of a connection portion for the screwdriver.

As will be appreciated, there can be other embodiments of the screwdriver 10 with a connection section 50' which include only first receiving slots 51 and not receiving slots 52, as is shown in FIG. 15. In this instance, the second storage container 200 can fit with the screwdriver. However, the storage container 100 would not be able to couple to the screwdriver 10 with connection section 50'.

As shown in FIG. 14, a latching member 240 is formed on the upper housing 210 of the storage container 201. The latching member 240 is a spring finger with an engagement portion 241 which is extended to engage the connection portion 50 or 50' of the screwdriver 10. As shown in FIG. 15, the screwdriver 10 may have a corresponding engagement receiving portion 246 which receives the engagement portion 241. The engagement receiving portion 246 is shown in FIG. 15, which illustrates connection portion 50'. The connection portion 50 may also include an engagement receiving portion 246. The connection section 50' also includes a label recess 247 for securing a label.

As will be appreciated, when the engagement portion 241 is engaged with the engagement receiving portion 246, the storage container 201 is held in the screwdriver 10. A user can remove the storage container 201 by sliding the container 200 off the connection portion 50 or 50' and overcoming the force of the engagement portion 241.

Returning to FIG. 14, the storage container 201 also includes a latch 260. The latch 260 can be closed to secure the storage container 201 in a closed position in which the upper and lower housing 210, 220 are held together. The latch 260 can also be opened to allow the upper housing 210 to move relative to the lower housing 220. Since the storage container 201 lacks second rails 121, latch 260 is the only feature preventing the storage container 201 from opening when it is coupled to the screwdriver 10. A similar latch 260 may also be used on the storage container 100. Additionally, as noted above, the attachment units 200, 300, 400 may include only a first rails 111. Accordingly, they may also be used with a screwdriver having the connection section 50'.

While the invention has been described by way of exemplary embodiments, it is understood that the words which have been used herein are words of description, rather than words of limitation. Changes may be made within the purview of the appended claims, without departing from the scope and spirit of the invention in its broader aspects.

What is claimed is:

1. A power tool, comprising:

a housing comprising a handle and a motor housing section, a longitudinal axis of the handle being at an offset angle with respect to a longitudinal axis of the motor housing section;

a motor housed in the motor housing section;

an output member selectively driven by the motor;

a user actuatable trigger for activating the motor; and an attachment unit removably coupled to the power tool;

wherein the handle runs from a first end to a second end, the first end being adjacent to the motor housing section and the second end being adjacent to a connection section;

wherein the attachment unit is removably coupled to the power tool at the connection section;

wherein the attachment unit slides onto the connection section in a direction generally parallel to the longitudinal axis of the motor housing section;

wherein the connection section includes at least one of a slot and rail and the attachment unit includes the other of a slot and a rail and wherein the slot and the rail engage to couple the attachment unit to the power tool; and wherein the attachment unit is a storage container.

2. The power tool of claim 1, wherein the storage container includes an upper housing and a lower housing which define a storage space therebetween.

3. The power tool of claim 2, wherein at least one of bits and screws are held in the storage container.

4. The power tool of claim 1, wherein the attachment unit slides onto the connection section to couple the attachment unit to the power tool.

5. The power tool of claim 1, wherein the attachment unit includes an upper housing and a lower housing;

wherein there is at least one first rail on the upper housing and at least one second rail on the lower housing;

wherein the connection section includes at least one first slot configured to receive the at least one first rail; and wherein the connection section includes at least one second slot configured to receive the at least one second rail.

6. The power tool of claim 1, wherein the power tool is a screwdriver.

7. A power tool, comprising:

a housing comprising a handle and a motor housing section, a longitudinal axis of the handle being at an offset angle with respect to a longitudinal axis of the motor housing section;

a motor housed in the motor housing section;

an output member selectively driven by the motor;

a user actuatable trigger for activating the motor; and an attachment unit removably coupled to the power tool;

wherein the handle runs from a first end to a second end, the first end being adjacent to the motor housing section and the second end being adjacent to a connection section;

wherein the attachment unit is removably coupled to the power tool at the connection section;

wherein the attachment unit slides onto the connection section in a direction generally parallel to the longitudinal axis of the motor housing section;

wherein the attachment unit is a storage container;

wherein the storage container includes an upper housing and a lower housing which define a storage space therebetween; and wherein the upper housing is movable relative to the lower housing at least when the storage unit is not coupled to the power tool.

8. A power tool, comprising:

a housing comprising a handle section, a motor housing section and a connection section;

a motor housed in the motor housing section;

an output member selectively driven by the motor;

a user actuatable trigger for activating the motor; and an attachment unit removably coupled to the connection section;

wherein the attachment unit includes an upper housing and a lower housing and a storage space is defined between the upper housing and the lower housing;

wherein the upper housing includes one of a slot and a rail and the connection section includes the other of a slot and a rail;

wherein the rail slides into the slot to connect the attachment unit to the connection section; and wherein the attachment unit slides onto the connection section in a direction generally parallel to the longitudinal axis of the motor housing section.

9. The power tool of claim 8, wherein the upper housing is movable relative to the lower housing at least when the attachment unit is not coupled to the connection section.

10. The power tool of claim 8, wherein the upper housing is rotatable relative to the lower housing at least when the attachment unit is not coupled to the connection section.

11. The power tool of claim 10, wherein the upper housing is connected to the lower housing via a hinge.

12. The power tool of claim 8, wherein, when the attachment unit is coupled to the connection section, the upper housing is not movable relative to the lower housing; and wherein, when the attachment unit is not coupled to the connection section, the upper housing is movable relative to the lower housing.

13. The power tool of claim 8, wherein the attachment unit further includes a latch which secures the attachment unit to the connection section when the attachment unit is fully coupled to the connection section.

14. The power tool of claim 13, wherein the latch is formed on the upper housing.

15. A power tool, comprising:

a housing comprising a handle, a motor housing section and a connection section;

a motor housed in the motor housing section;

an output member selectively driven by the motor;

a user actuatable trigger for activating the motor; and an attachment unit removably coupled to the connection section;

wherein the attachment unit includes an upper housing and a lower housing and a storage space is defined between the upper housing and the lower housing;

wherein the connection section has a first slot and a second slot;

wherein the upper housing has a first rail;

wherein the lower housing has a second rail;

wherein the first rail engages the first slot; and wherein the second rail engages the second slot.

16. The power tool of claim 15, wherein the handle runs from a first end to a second end, the first end being adjacent to the motor housing section and the second end being adjacent to the connection section; and wherein a longitudinal axis of the handle is at an offset angle with respect to a longitudinal axis of the motor housing section.

* * * * *